US009060584B2

(12) United States Patent
Debauge et al.

(10) Patent No.: US 9,060,584 B2
(45) Date of Patent: Jun. 23, 2015

(54) DEVICE FOR PREPARING A COSMETIC COMPOSITION, KIT AND ASSOCIATED METHOD

(75) Inventors: Anne Debauge, Montgeron (FR); Christian Revenu, Livry-Gargan (FR)

(73) Assignee: L'OREAL, Paris (FR)

( * ) Notice: Subject to any disclaimer, the term of this patent is extended or adjusted under 35 U.S.C. 154(b) by 1196 days.

(21) Appl. No.: 12/981,685

(22) Filed: Dec. 30, 2010

(65) Prior Publication Data

US 2011/0155629 A1 Jun. 30, 2011

Related U.S. Application Data

(60) Provisional application No. 61/297,990, filed on Jan. 25, 2010.

(30) Foreign Application Priority Data

Dec. 31, 2009 (FR) ..... 09 59692

(51) Int. Cl.

| | |
|---|---|
| ***B01F 15/02*** | (2006.01) |
| ***A45D 34/00*** | (2006.01) |
| ***A45D 19/00*** | (2006.01) |
| *A45D 44/00* | (2006.01) |

(52) U.S. Cl.

CPC ..... *A45D 34/00* (2013.01); *A45D 19/00* (2013.01); *A45D 44/00* (2013.01); *A45D 2019/0066* (2013.01); *A45D 2200/058* (2013.01); *A45D 2200/25* (2013.01); *B01F 15/0201* (2013.01); *B01F 15/0223* (2013.01)

(58) Field of Classification Search

CPC ..... A45D 34/00

USPC ..... 366/129, 130, 173.2, 176.3

See application file for complete search history.

(56) References Cited

U.S. PATENT DOCUMENTS

| | | | | |
|---|---|---|---|---|
| 886,075 | A * | 4/1908 | Remington | 15/104.001 |
| 3,642,499 | A | 2/1972 | Castell | |
| 5,330,048 | A | 7/1994 | Haber et al. | |
| 6,447,476 | B1 * | 9/2002 | Sogaro | 604/85 |
| 8,465,197 | B2 * | 6/2013 | Faccioli et al. | 366/130 |
| 2009/0207686 | A1 * | 8/2009 | Faccioli et al. | 366/130 |

FOREIGN PATENT DOCUMENTS

| | | | |
|---|---|---|---|
| CH | 631 894 | 9/1982 | |
| WO | WO 00/45732 | 8/2000 | |
| WO | WO 2007000631 A1 * | 1/2007 | A61F 2/46 |

* cited by examiner

*Primary Examiner* — David Sorkin
*Assistant Examiner* — Abbas Rashid
(74) *Attorney, Agent, or Firm* — Novak Druce Connolly Bove + Quigg LLP

(57) ABSTRACT

A device includes a base container delimiting an inner space receiving a first cosmetic product. It includes a compression wall, mounted so as to be slideably mobile in the inner space through an insertion aperture between an outer position and an inner position. The compression wall delimits through-passages for circulation of the first cosmetic product, each through-passage opening out into the inner space. The device includes a receptacle for mixing the cosmetic composition including the compression wall and a side wall displaceable together with the compression wall. The side wall protrudes from the compression wall and delimits a mixing space into which the through-passage opens out.

11 Claims, 8 Drawing Sheets

DEVICE FOR PREPARING A COSMETIC COMPOSITION, KIT AND ASSOCIATED METHOD

CROSS-REFERENCE TO RELATED APPLICATIONS

This application claims the benefit of priority under 35 U.S.C. §119(e) of Provisional Application No. 61/297,990, filed Jan. 25, 2010, and claims the benefit of priority under 35 U.S.C. §119 from French Application No. 09 59692, filed Dec. 31, 2009, the entire contents of each of which are herein incorporated by reference

FIELD OF THE INVENTION

The present invention relates to a device for preparing a cosmetic composition, of the type comprising:

- a base container delimiting an inner space receiving a first cosmetic product, the inner space opening out through an insertion aperture;
- a wall for compressing the first cosmetic product, mounted so as to be slideably mobile in the inner space through the insertion aperture between an outer position and an inner position for compressing the first cosmetic product, the compression wall delimiting at least one through-passage for the flow of the first cosmetic product, the through-passage opening out into the inner space.

BACKGROUND OF THE INVENTION

Discussion of Background

The cosmetic composition is advantageously prepared from at least one first cosmetic product which may be difficult to homogenize, because of its viscosity or of its presentation in dispersed form. This first cosmetic product for example appears as beads comprising a core containing a cosmetic active ingredient and a retaining shell coating the core.

The cosmetic composition is for example a cream intended to be applied on a body surface, or more generally on keratinous materials of a user such as the skin or keratinous fibres. The cosmetic composition is in particular a formulation applied on hair or a makeup composition intended to be in particular applied on the lips, the face, the cheeks, the eyelids or eyelashes.

By "cosmetic product", is more generally meant a product as defined in the Directive 93/35 EEC of the Council as of Jun. 30, 1993.

The device is advantageously intended for preparing an extemporaneous mixture of cosmetic products for forming the cosmetic composition. In this case, the presence of a first cosmetic product difficult to homogenize complicates the preparation of the extemporaneous mixture.

In particular, when the first cosmetic product is conditioned as beads which have to be mixed with a second cosmetic product, the user has to mechanically break the shell of the beads, in order to ensure that the final composition actually obtained has the properties desired by the user. Indeed, the final composition should contain the active ingredient in released form, capable of interacting with the surface on which it is applied.

In a known way, U.S. Pat. No. 5,660,342, U.S. Pat. No. 5,058,770, and U.S. Pat. No. 2,771,383 describe preparation devices with which a mixture of products may be obtained.

These devices are however not adapted when one of the products is difficult to homogenize, for example when it appears as beads.

U.S. Pat. No. 2,726,816 describes a device with which a product may be crushed, but which is not adapted for producing a mixture of cosmetic products.

In order to improve the preparation of a cosmetic composition, the French application FR 2 913 004 of the Applicant describes a preparation device in which a first product and a second product as beads are mixed in a mixing chamber, and are then extruded through a wall having a plurality of through-passages. The extruded formulation is directly applied on a body surface of a user.

Such a device is therefore very satisfactory when the cosmetic composition is intended to be immediately applied on a body surface. However, this device does not allow the composition to be worked once the mixing between the products is achieved. Indeed, it does not allow any improvement of the composition by gradually adjusting the amounts of the different products.

US 2005/0127215 describes a device of the aforementioned type, in which the compression wall of a first product is formed by a piston circulating in a mixing chamber. However, the presence of the piston does not make the handling of the device very convenient with view to producing a cosmetic composition, in particular based on two cosmetic products, at least one of which is difficult to homogenize.

SUMMARY OF THE INVENTION

An object of the invention is therefore to obtain a device for preparing a cosmetic composition from at least one cosmetic product which is difficult to homogenise, which device is particularly efficient for producing a homogeneous composition, while being simple to use.

Another object of the invention is to obtain a device with which it is possible to substantially quantitatively and homogeneously recover a first cosmetic product conditioned as beads with view to mixing it optionally with a second cosmetic product in order to obtain a homogeneous cosmetic composition.

For this purpose, the object of the invention is a device of the aforementioned type, characterized in that the device comprises a receptacle for mixing the cosmetic composition, the receptacle including:

- the compression wall;
- a side wall jointly displaceable with the compression wall, the side wall protruding from the compression wall and delimiting a mixing space into which the through-passage opens out,
- the receptacle delimiting at least one aperture for accessing the mixing space opening outwards from the device when the compression wall occupies its inner position, the access aperture being distinct from the through-passage.

The device according to the invention may comprise one or more of the following features, taken individually or according to any technically possible combination:

- the side wall of the receptacle has an outer contour of complementary shape to the inner contour of the insertion aperture;
- a peripheral seal gasket is interposed between the side wall and the container during displacement of the compression wall between the outer position and the inner position in order to force the first cosmetic product towards the mixing space through the through-passage;

the base container includes a bottom wall, the compression wall abutting against the bottom wall in the inner position;

the base container comprises a supporting surface on a support, the insertion aperture opening out upwards when the supporting surface is laid on the support;

the side wall protrudes out of the inner space of the container when the receptacle occupies its inner position;

the side wall comprises a lower portion with dimensions substantially complementary to the inner space of the base container, and an upper portion with an increasing inner section upon moving away from the compression wall;

the compression wall delimits a plurality of through-passages connecting the inner space to the mixing space;

the first cosmetic product is formed by a plurality of deformable beads including a core and a frangible outer shell retaining the core;

the base container includes a releasable assembly for obturating the insertion aperture, advantageously fixedly mounted to the side wall;

the access aperture opens out facing the through-passage;

the peripheral wall delimits an inner relief for marking a product level, the inner relief being positioned in the mixing space;

the first cosmetic product comprises beads, the through-passage having a maximum transverse dimension smaller than the minimum transverse dimension of the beads.

The object of the invention is also a kit for preparing a cosmetic composition, of the type comprising:

a device as defined above;

a package capable of containing the device, the base container being in particular positioned in the package totally away from the mixing receptacle.

The kit according to the invention may comprise one or more of the following features, taken individually or according to any technically possible combination(s):

the base container comprises a removable cap obturating the insertion aperture, the kit advantageously comprising a plurality of base containers;

it includes a container including a second cosmetic product distinct from the first cosmetic product, the second cosmetic product being intended to be introduced into the mixing space in order to be mixed therein with the first cosmetic product.

The object of the invention is also a method for preparing a cosmetic composition, of the type comprising the following steps:

providing a device as defined above, the base container containing a first cosmetic product;

introducing the mixing receptacle into the inner space through the insertion aperture:

passing the mixing receptacle from its outer position to its inner position for compressing the first cosmetic product;

causing flow of the first cosmetic product from the inner space to the mixing space through said or each through-passage.

The method according to the invention may comprise one or more of the following features, taken individually or according to any technically possible combination(s):

it comprises a step for positioning a second cosmetic product in the mixing space, the positioning step being advantageously carried out before the step for displacing the receptacle between its outer position and its inner position;

the first cosmetic product is formed by a plurality of deformable beads including a core and a frangible outer shell retaining the core, the passing of the beads through said or each through-passage causing breakage of the outer shell and release of the core.

BRIEF DESCRIPTION OF THE DRAWINGS

The invention will be better understood upon reading the description which follows, only given as an example, and made with reference to the appended drawings, wherein.

DETAILED DESCRIPTION OF THE PREFERRED EMBODIMENTS

Figure 1:
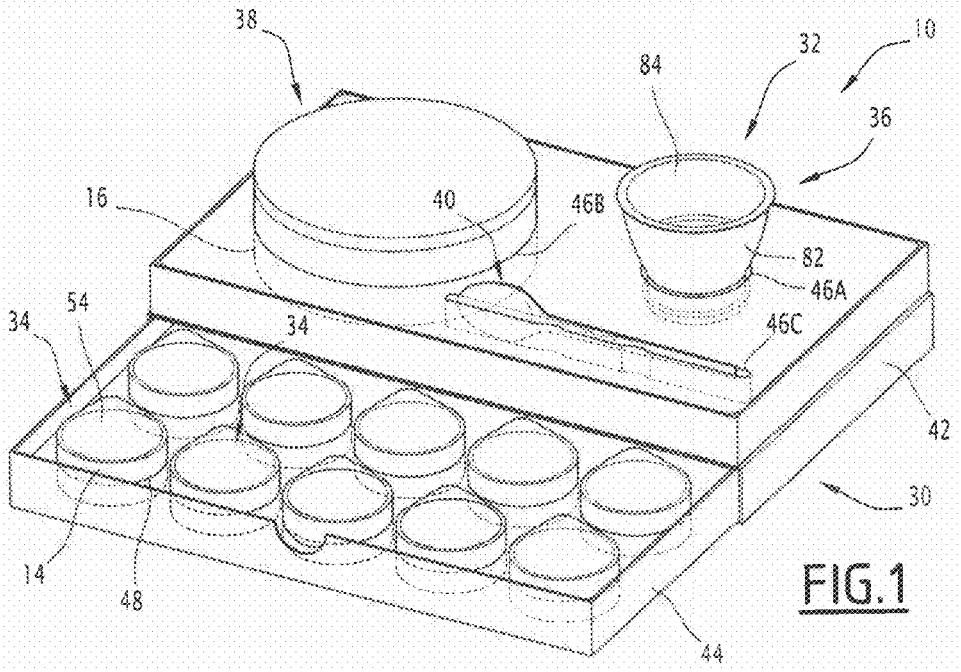
FIG. 1 is an outer perspective view of a first kit according to the invention containing a first preparation device.
Figure 7:
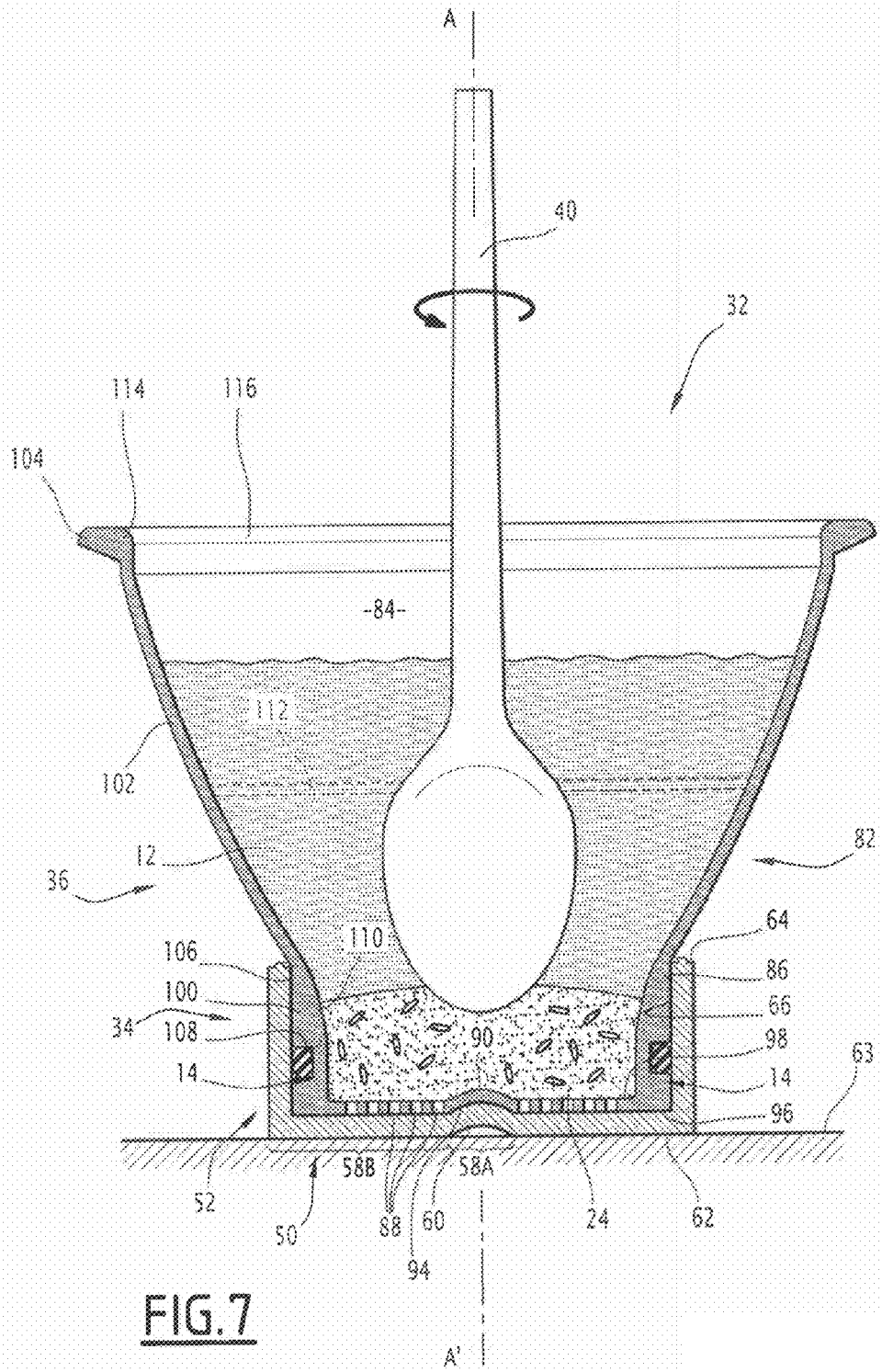
FIG. 7 is a view analogous to FIG. 5, during a third step for preparing the cosmetic product.

A first kit 10 for preparing a cosmetic composition 12 visible in FIG. 7 is illustrated in FIG. 1.

The cosmetic composition 12 is advantageously a cream intended to be applied on a body surface of a user, such as for example the skin or a keratinous fibres.

This composition is in particular intended for hair care or their dying.

Alternatively, the cosmetic composition 12 is a make-up composition intended to be applied on the face such as for example on the cheeks, on the eyelids, on the forehead, on the eyelashes or eyebrows.

The composition 12 appears as a cream, a gel or a viscose liquid with a viscosity of more than 500 mPa·s.

The composition 12 is made extemporaneously, based at least one first cosmetic 14 which has to be homogenized with view to its use, and advantageously based on a second cosmetic product 16.

The first cosmetic product 14 is a product present in viscous or dispersed form.

In the example illustrated in FIGS. 1 to 7, the first cosmetic product 14 is formed by a plurality of substantially spherical beads 18, sometimes designated by the term of "synthetic caviar".

Each bead 18 includes a core 20 comprising a cosmetic active ingredient and a shell 22 for retaining the core 20. The beads 18 are for example maintained immersed in a liquid solution 24, in particular in suspension in the solution 24.

The shell 22 coats the whole periphery of the core 20. For example, it is made from alginate gel. The shell 22 is intended to be broken for example upon applying a mechanical stress, for releasing the core 20.

The diameter of the beads 18 is advantageously comprised between 1 mm and 5 mm, in particular between 2.0 mm and 3.5 mm.

The liquid solution 24 is advantageously an aqueous solution, preferably as a gel.

Exemplary make-up formulations containing beads are described in WO 2009/081370 and WO 2009/081351.

The second cosmetic product 16 is for example formed by a liquid, a gel, a cream or a solid suspension in a liquid. An example of a second cosmetic product is a hair conditioner care containing a fatty alcohol, a cationic surfactant, and silicone, for example as described in EP-0 551 498. This care may contain nanocapsules, as described in EP-0 447 318.

With reference to FIG. 1, the first kit 10 comprises a package 30 and a first preparation device 32 according to the invention, the device 32 including at least one base container 34 containing the first cosmetic product 14 and a mixing receptacle 36.

The kit 10 advantageously comprises a container 38 receiving the second cosmetic product 16 and at least one tool 40 for mixing and applying the cosmetic composition.

In the example illustrated in FIG. 1, the package 30 includes a supporting case 42 and a mobile drawer 44 which may be deployed relatively to the case 42.

The case 42 delimits respective housings 46A, 46B, 46C for receiving the mixing receptacle 36, a container 38 and the tool 40.

The mobile drawer 44 also delimits a plurality of housings 48 for receiving base containers 34.

The package 30 may further have a lid (not shown) intended for capping the case 42 in order to protect the device 32 and the container 38 during storage of the kit 10.

As illustrated in FIG. 1, the kit 10 includes in this example a plurality of analogous base containers 34.

Figure 2:
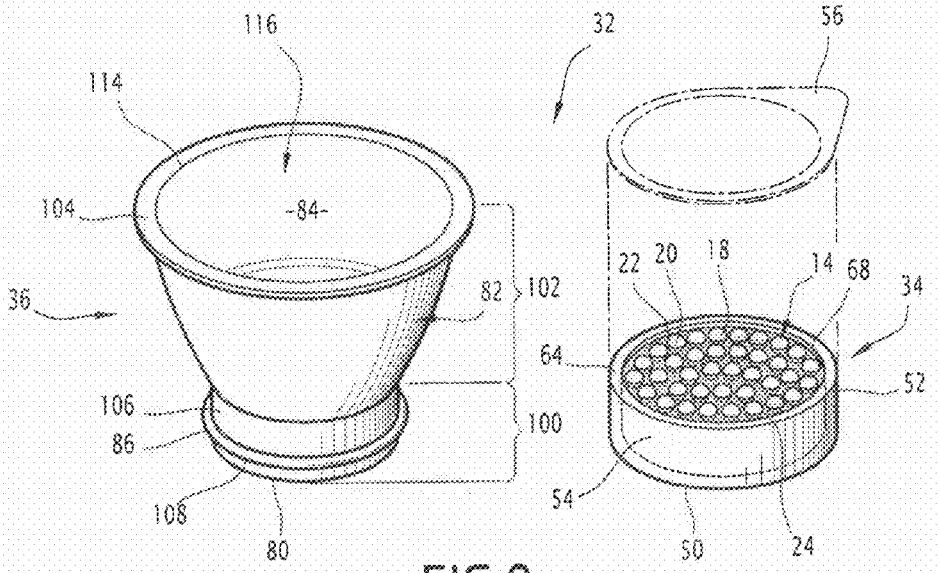
FIG. 2 is a schematic perspective view of the preparation device of the kit of FIG. 1.

With reference to FIG. 2 each base container 34 includes a bottom wall 50, a peripheral wall 52 delimiting with the bottom wall 50 an inner space 54, and a removable cap 56 for obturating the inner space 54, illustrated in dotted lines in FIG. 2.

As this will be seen below, the bottom wall 50 and the side wall 52 are advantageously made in a single piece while being made in the same material, for example, in thermoplastic or metal material.

Figure 5:
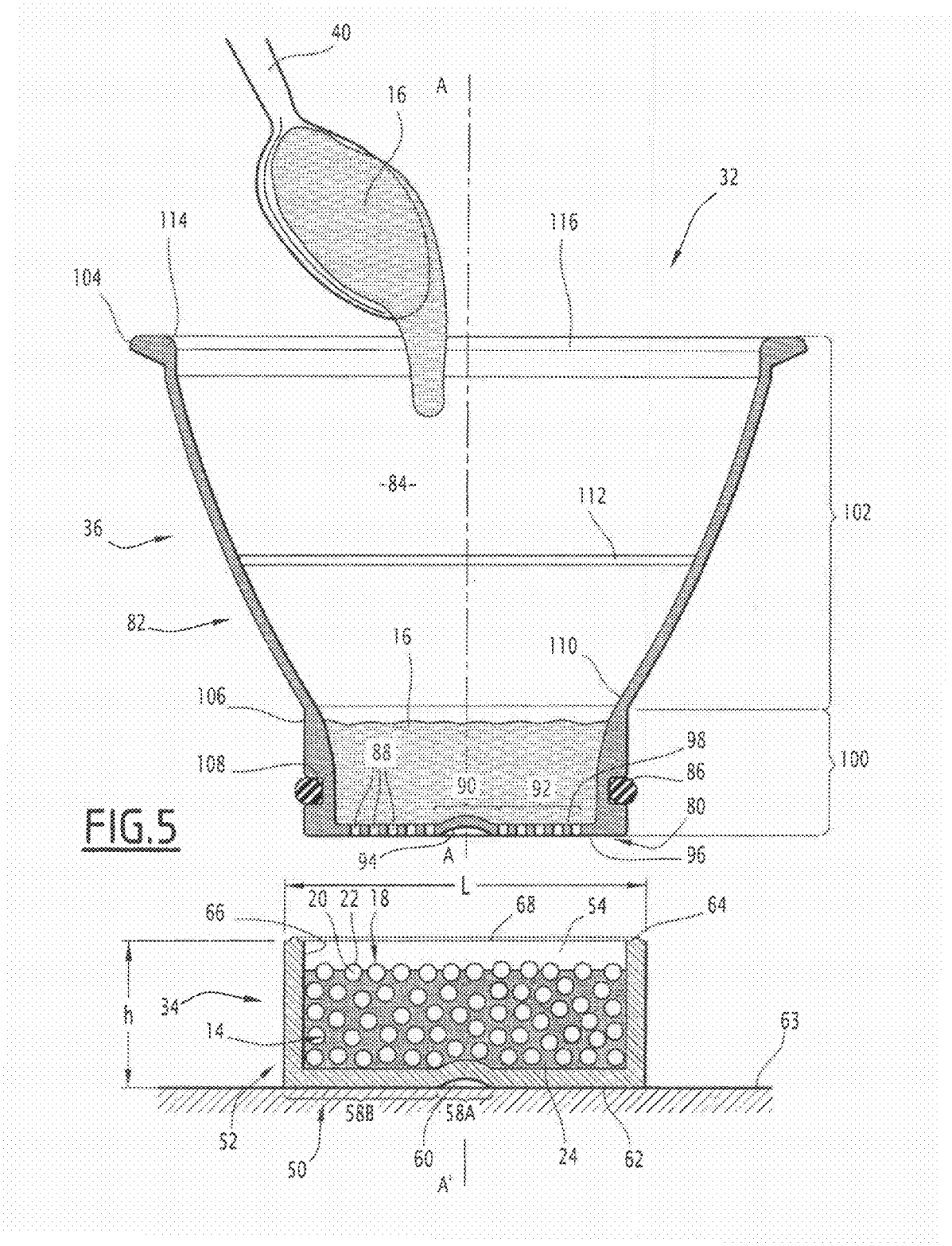
FIG. 5 is a sectional view along a median vertical plane of the device of FIG. 2, during a first step of a method for preparing a cosmetic composition.

In this example, as illustrated by FIG. 5, the bottom wall 50 includes a central dome-shaped region 58A and a peripheral substantially flat region 58B.

The central region 58A delimits a concave cavity 60 receiving the point for injecting the plastic material intended to form the walls 50, 52.

The peripheral region 58B delimits a planar lower surface 62 intended to be laid on a support 63.

In the example illustrated in FIGS. 1 to 7, the peripheral wall 52 has a maximum height h smaller than the maximum width I of the bottom wall 50.

The peripheral wall 52 protrudes upwards from the bottom wall 50 as far as a free edge 64 receiving the cap 56.

The peripheral wall 52 has a closed outer contour. In this example, the outer contour is circle-shaped. Alternatively, the outer contour of the wall 52 is of a polygonal shape or elongated shape, for example in the shape of an ellipse.

The side wall 52 delimits an inner surface 66 with a substantially constant cross-section upon moving along a central axis A-A' for introducing the receptacle 36 into the base container 34.

The inner volume 54 is sealably delimited downwards, by the bottom wall 50, and outwards by the side wall 52. It opens out upwards through an upper aperture 68 for inserting the receptacle 35 into the inner space 54.

During the storage of the first kit 10, before introducing the mixing receptacle 36 into the base container 34, the inner space 54 contains the first cosmetic product 14, advantageously as beads 18 maintained in a solution 24. The first cosmetic product 14 preferably occupies more than 50% of the inner space 54.

Figure 8:
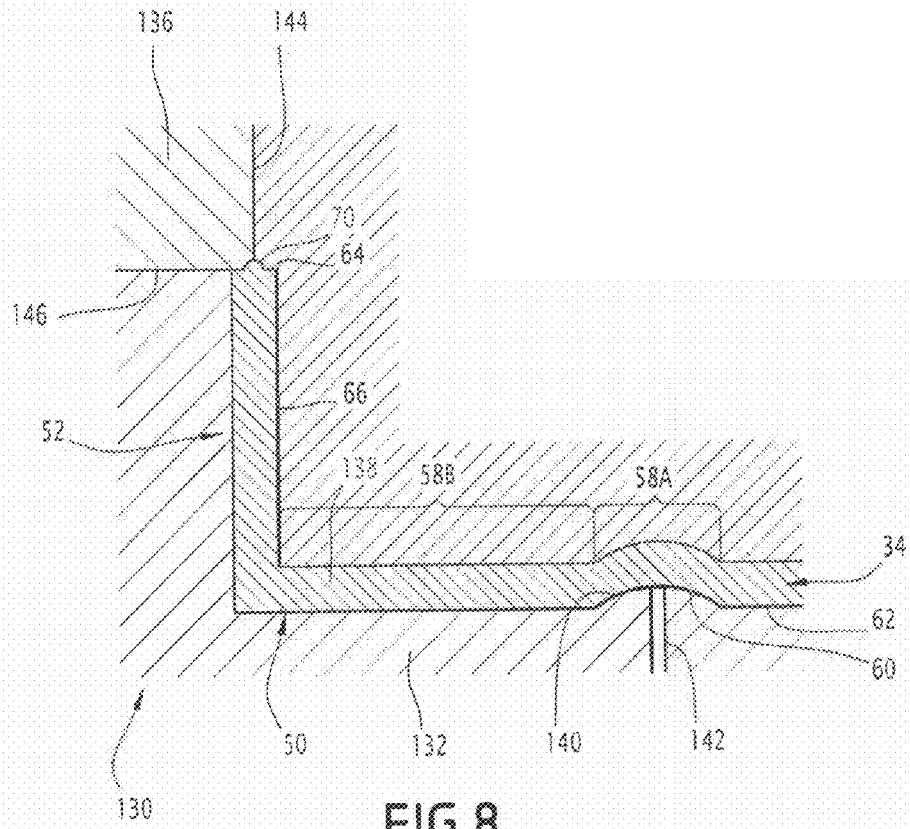
FIG. 8. is a schematic sectional view along a median vertical plane of the mould for making a base container of the device according to the invention.

As illustrated by FIG. 8, before setting the cap 56 into place, the free edge 64 includes an annular ring 70 protruding upwards. The ring 70 is advantageously intended to be melted during the attachment of the cap 56 onto the free edge 64, in order to attach the cap 56 by heat-sealing.

The cap 56 is for example made on the basis of a more flexible film than the bottom wall 50 and then the side wall 52. The cap 56 is removably attached on the free edge 64, for example by heat-sealing or/and by applying an adhesive.

It sealably obturates the inner space 54 outwards, at the upper aperture 68.

The cap 56 is manually peelable by a user in order to clear the insertion aperture 68 and to allow access to the inner space 54.

As illustrated by FIGS. 2 to 7, the mixing receptacle 36 has the general shape of a funnel opening upwards.

According to the invention, the mixing receptacle 36 includes a pierced lower wall 80 intended to compress the first cosmetic product 14, a hollow side wall 82, delimiting with the lower wall 80 a space 84 for mixing the first cosmetic product 14. In the example illustrated in the figures, the receptacle 36 further includes a peripheral seal gasket 86, intended to be interposed between the base container 34 and the mixing receptacle 36 upon introducing the mixing receptacle 36 into the base container 34.

Figure 3:
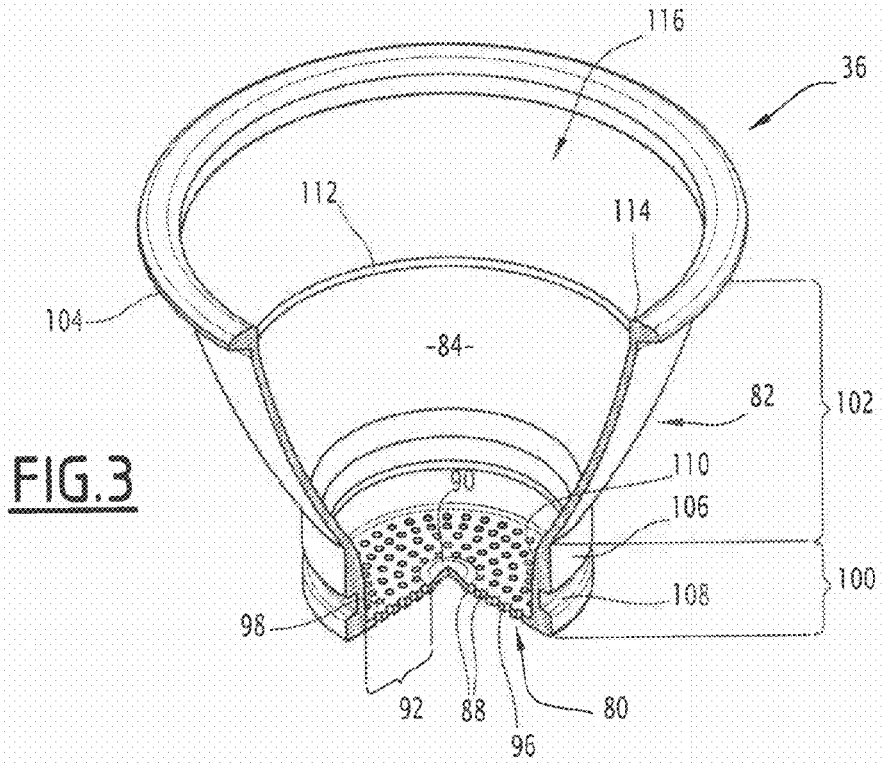
FIG. 3 is a partly cutaway perspective view of the mixing receptacle of the device of FIG. 2.
Figure 4:
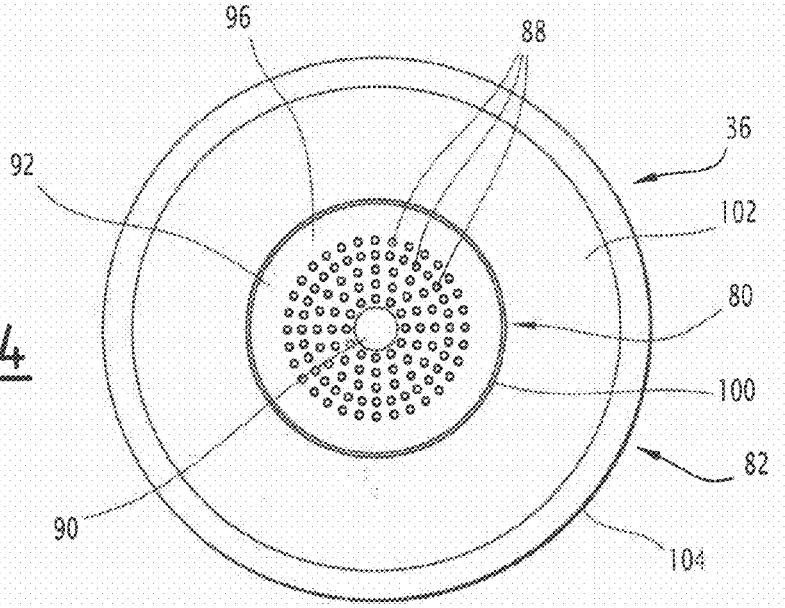
FIG. 4 is a partial top view of the receptacle of FIG. 3.

As illustrated by FIGS. 3, 4 and 5, the lower wall 80 delimits a plurality of through-passages 88 intended to have the cosmetic product 14 circulate between the inner space 54 and the mixing space 84.

In this example, the lower wall 80 is intended to extend substantially parallel to the bottom wall 50 of the base receptacle, perpendicularly to the introduction axis A-A'. The lower wall 80 includes, in this example, a solid central region 90, convex upwards, and an annular peripheral region 92 delimiting the circulation passages 88.

The central region 90 is of a shape substantially analogous to the central region 52 of the base container 34. It delimits a lower cavity 94 into which is received the point for injecting the thermoplastic material intended to form the mixing receptacle 36.

The lower wall 80 delimits a lower surface 96 for bearing upon the first cosmetic product 14 and an upper surface 98 delimiting the mixing space 84 downwards.

The passages 88 are made through the wall 80 parallel to the axis A-A'. They open out upwards through the upper surface 98 into the mixing space 84. They open out downwards through the lower surface 96 intended to be placed in the inner space 54.

As illustrated by FIG. 4, the cross-section of each passage 88 is much smaller than the cross-section of the surface 96, taken in a plane perpendicular to the axis A-A'. The cross-section of each passage 88 is in particular less than 10% of the total section of the lower surface 96, and for example is less than 2 $mm^2$.

Advantageously, the maximum transverse extent of each passage 88 is less than the maximum transverse extent of each bead 18.

As illustrated by FIG. 4, the passages 88 are distributed radially and angularly around the axis A-A'. The number of passages 88 is for example greater than 10, advantageously greater than 100.

The outer contour of the bottom wall 80, taken at the periphery of the lower surface 96, is conjugate with the inner contour of the insertion aperture 68 and of the inner space 54, as delimited by the inner surface 66.

As illustrated by FIGS. 2 to 7, the side wall 82 protrudes upwards from the peripheral edge of the lower wall 80. It has an outer contour cross-section closed on substantially the whole of its height.

The side wall 82 comprises a lower portion 100 intended to be introduced into the base container 34 and a flared upper portion 102, intended to protrude out of the base container 34. In this example, it further includes a peripheral edge protruding away from the axis A-A' from the upper portion 102.

In this example, the lower wall 80 and the side wall 82 are made in a single piece in the same material for example, based on a thermoplastic or thermosetting or metal material.

The height of the lower portion 100, taken parallel to the axis A-A', is less than the height of the upper portion 102, taken parallel to the axis A-A'.

The height of the lower portion 100 is substantially equal to the depth of the inner space 54 taken along the axis A-A'.

The lower portion 100 delimits an outer contour surface 106 which is substantially constant upon moving parallel to the axis A-A', except for an annular groove 108 for receiving the peripheral gasket 86.

The outer contour of the outer surface 106 is substantially complementary to the inner contour of the inner space 54 and of the upper aperture 68.

The annular groove 108 opens out radially away from the axis A-A'. It has a height, taken parallel to the axis A-A', substantially equal to the height of the gasket 86 and a depth, taken perpendicularly to the axis A-A', smaller than the maximum thickness of the gasket 86.

The lower portion 100 further delimits an inner surface 110 having a lower region of constant section and an upper region of increasing section upon moving upwards along the axis A-A'.

The upper portion 102 diverges radially away from the axis A-A' upon moving axially away from the lower wall 80. It advantageously includes at least one relief 112 forming a graduation intended to allow metering of the second product 16, in the mixing space 84.

The edge 104 protrudes radially away from the upper portion 102 from the free edge 114 of this portion. The edge 104 is wide for better comfort for the hands during the pressing, when the mixing receptacle 36 is moved by driving it into the base container 34.

The mixing space 84 delimited by the walls 80, 82 is greater than the receiving space 54. It is sealably delimited laterally outwards by the side wall 82. It is partly delimited downwards by the lower wall 80. It opens out downwards through each circulation passage 88.

Further, the mixing receptacle 36 delimits an upper aperture 116 for accessing the mixing space 84, distinct from each circulation passage 88 for allowing access to the mixing space 84 once mixing is achieved.

The aperture 116 opens upwards and extends axially facing the passages 88 opposite to the lower wall 80.

The aperture 116 has a cross-section, taken perpendicularly to the A-A' axis, much larger than the cross-section of each circulation passage 88, for example of more than twice the cross-section of each circulation passage 88 and in particular more than twice the sum of the cross-sections of each of the circulation passages 88.

As this will be seen below, the mixing receptacle 36 is mobile between an extracted position out of the base container 34, illustrated in FIG. 5 and an outer position engaged on the base container 34.

The receptacle 36 is further slideably displaceable along the axis A-A' in the inner space 54 from the outer position towards an inner position for compressing the cosmetic product 14, illustrated in FIG. 7. In alternatives not shown, this slide may operate by guiding means such as complementary screwing threads, a bayonet system or further with a rack system preventing detachment of the receptacle 36 relatively to the base container 34.

In the extracted position, illustrated in FIG. 5, the upper aperture 68 delimited by the base container 34 has been cleared. The mixing receptacle 36 is totally located away from the base container 34. Its side wall 82 may be laid on the support 63 beside the base container 34.

In the outer position, the inner wall 80 of the mixing receptacle 36 was introduced into the insertion aperture 68 and obturates the insertion aperture 68 upwards.

The peripheral seal gasket 86 is positioned, bearing upon the free edge 64 of the side wall 52. The cosmetic product 14 is positioned under the pierced lower wall 80, in the space delimited between the lower wall 80 and the bottom wall 50.

In the inner position, the gasket 86, the lower portion 100 of the side wall 82 and the lower wall 80 have been forcibly introduced into the inner space 54.

The gasket 86 sealably obturates the annular space present between the peripheral wall 52 of the base container 34 and the side wall 82 of the mixing receptacle 36.

The lower wall 80 has been displaced towards the bottom wall 50 by driving out the first cosmetic product 14 present in the inner space 54 towards the mixing space 84 in order to reduce the space present between the pierced lower wall 80 and the bottom wall 50.

In the example illustrated by FIG. 7, the lower wall 80 is positioned in abutment against the bottom wall 50 in the inner position. The bottom wall 50 obturates the passages 88 towards the outside, making access impossible to the mixing space 84 through the passages 88.

As this will be seen below, the cosmetic product 14 present in the inner space 54 between the bottom wall 50 and the pierced lower wall 80 was pushed into the mixing space 84 through the circulation passages 88, by compression between the bottom wall 50 and the lower wall 80.

In the inner position, the lower portion 100 of the side wall 82 is received in a substantially complementary way into the inner space 54. The upper portion 102 of the side wall 82 protrudes upwards out of the inner space 54, above the free edge of the peripheral wall 52.

The aperture 116 remains clear, which allows distribution of the composition 12 out of the mixing space 84 through the aperture 116, without having to separate the side wall 82 from the bottom wall 80.

The gasket 86 has a toric shape. For example it is made in a more flexible plastic material than the walls 82, 52, such as silicone or rubber, or further a thermoplastic. Advantageously, the gasket 86 is based on acrylic nitrile rubber. The gasket 86 protrudes out of the groove 108 radially so as to be applied on the inner surface 66 while being slightly compressed.

Alternatively, the gasket 86 is made with one of the walls 82, 52 in the same material.

The base container 34 of the first kit 10 according to the invention is advantageously made by injection moulding of a plastic or metal material in a first mould 130 illustrated in FIG. 8.

The first mould 130 comprises a hollow base die 132, capable of delimiting the lower surface 62 of the bottom wall 50 and the outer surface of the side wall 52, a central punch 134 capable of delimiting the inner surface of the bottom wall 50 and the inner surface 66 of the side wall 52. The first mould 130 further includes an outer shell 136 capable of partly delimiting the ring 70 and the free edge 64.

The die 132, the punch 134 and the outer shell 136 are mobile relatively to each other, between a closed position for injection of thermoplastic material, in which they delimit a moulding imprint 138 with a shape which makes the shape of the base container 34, and an open position for accessing the mould 130, in which the base container 34 formed in the mould 130 may be removed from the mould.

In the closed position, the die 132 delimits a central protrusion 140 intended to form the cavity 60. The central protrusion 140 interiorly defines a material injection channel 142 opening out into the imprint 138.

The punch 134 and the outer shell 136 delimit between them a first peripheral gasket plane 144 which extends axially in the extension of the side wall 52 above the ring 70. The outer shell 136 and the die 130 further delimit a second gasket plane 146 perpendicular to the first gasket plane 144. The second gasket plane 146 is flush with the free edge 64 at the outer surface of the side wall 52.

Upon injecting the fluid material intended to form the base container 34 into the imprint 138 of the first mould 130, the presence and the localisation of the gasket planes 144, 146 guarantee adequate gas discharge so that the ring 70 is formed in a suitable way and so that the inner surface 66 delimited by the side wall 52 is substantially smooth and of constant section. This guarantees a suitable seal during the introduction of the mixing receptacle 36 into the base container 34.

Once the material forming the container 34 is solidified, the punch 134 and the outer shell 136 are open and the container 34 is ejected away from the die 132.

Figure 9:
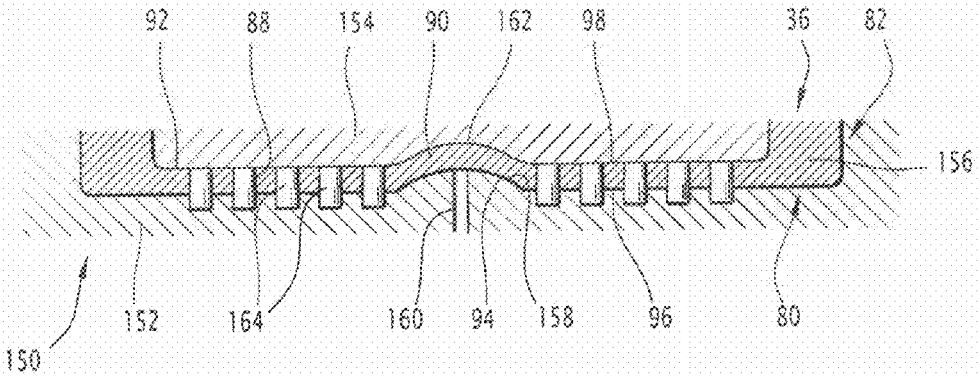
FIG. 9 is a view analogous to FIG. 8 of a relevant portion of the mould for making the receptacle.

A second mould 150, intended for making the receptacle 36, is partly illustrated in FIG. 9.

This mould 150 comprises a second die 152 with a complementary shape to the outer surface of the receptacle 36 and a punch 154 mounted so as to be mobile relatively to the die 152 in order to delimit the inner surface of the receptacle 36.

In a closed position of the mould 150, the die 152 and the punch 154 delimit together an imprint 156 with a complementary shape to the receptacle 36. For this purpose, in the region intended to form the pierced lower wall 80, the die delimits a protrusion 158 defining a material injection channel 160.

The punch 154 delimits a recess 162 facing the protrusion 158.

Moreover, in order to form the passages 88, the mould 150 comprises a plurality of removable pegs 164, with conjugate dimensions with each passage 88. In this example, the pegs 164 are removably mounted in the die 152 around the protrusion 158. This allows their easy replacement and simple adjustment of the dimension of the passages 88.

In the closed position of the second mould 150, the punch 154 bears upon the free ends of the pegs 164. During injection of material through the channel 160, the material is distributed in the imprint 156, in particular around the pegs 164 in order to form the lower wall 80 with a plurality of calibrated circulation passages 88.

Next, after at least partial solidification of the material, the punch 154 is displaced relatively to the die, and the receptacle 36 is ejected out of the imprint 156.

In order to ensure good mechanical strength, the thickness of the lower wall 80 is of at least 1 mm. This thickness is greater than at least once the diameter of a circulation passage such as 88.

A first method for preparing a cosmetic composition 12 with the first kit 10 will now be described.

Initially, the first cosmetic product 14 is stored in each base container 34 received in the package 30. The first cosmetic 14 is confined in each base container 34 by the presence of a cap 56 assembled on the side wall 52.

Moreover, the second cosmetic product 16, when it is used for preparing the composition 12, is stored in the container 38 which may be received into the package 30 or positioned outside the package 30.

The mixing receptacle 36 is also stored in the package 30.

When the user wishes to prepare the cosmetic composition, he/she extracts out of the package 30 a base container 34 and positions it on a support 63. He/she then opens the cap 52 in order to clear the access to the inner space 54 through the upper aperture 68 which opens out upwards.

In the example illustrated in FIG. 5, the cosmetic product 14 is present in the form of beads 18 in the inner space 54.

Next, as illustrated by FIG. 5, the user brings the mixing receptacle 36 opposite to the base container 34 by placing the pierced lower wall 80 above the insertion aperture 68.

He/she then displaces the lower wall 80 towards the free edge 64 and inserts the lower wall 80 into the inner space 54. The mixing receptacle 36 then occupies its outer position. The first cosmetic product 14 is then confined between the walls 80 and 50, 52.

Once the lower wall 80 is engaged, it bears upon the mixing receptacle 36 in order to slideably displace the lower wall 80 along the axis A-A' towards the bottom wall 50 of the base container 34.

The force required for displacing the receptacle 36 in the container 34 is for example comprised between 10 N and 100 N, in particular between 40 N and 60 N.

Figure 6:
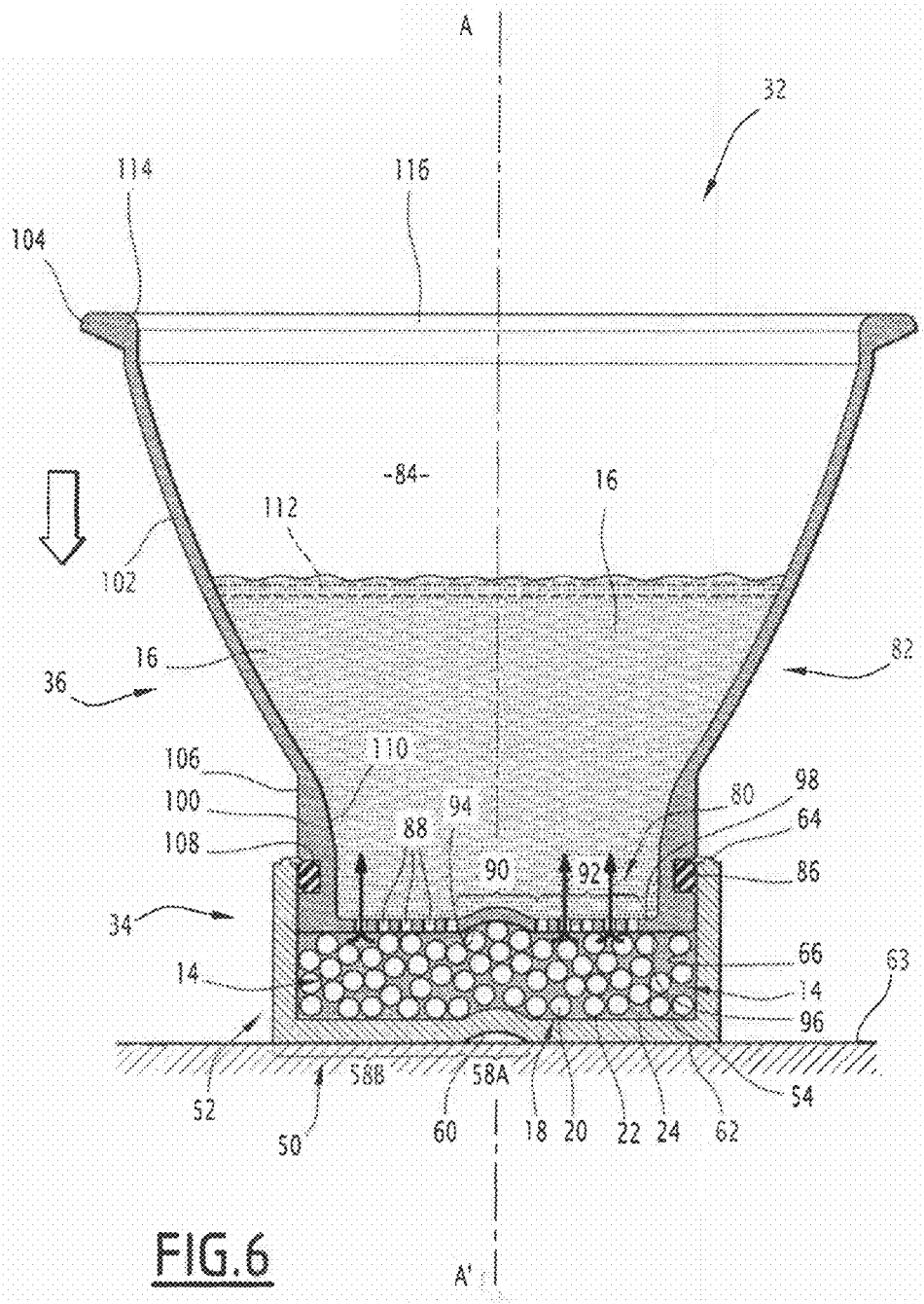
FIG. 6 is a view analogous to FIG. 5, during a second step for preparing the cosmetic product.

During this displacement, the lower surface 96 of the lower wall 80 comes into contact with the cosmetic product 14. The volume of the space located between the lower wall 80 and the bottom wall 50 gradually decreases as illustrated by FIG. 6.

As this volume is sealably obturated at the periphery of the side wall 82 by the gasket 86, the displacement of the lower wall 80 towards the bottom wall 50 causes compression of the first cosmetic product 14 contained in the inner space 54 and its expulsion towards the mixing space 84, exclusively through the through-passages 88.

The compression of the cosmetic product 14 between the walls 50, 80 and the expulsion through the through-passages 88 generate mechanical stresses, in particular sheering stresses on the first cosmetic product 14.

In the case when this product is in the form of beads 18, the shell 22 of the beads 18 breaks for releasing the core 20 into the mixing space 84.

The displacement of the lower wall 80 towards the bottom wall 50 continues until the receptacle 36 reaches its lower position, in which the walls 50, 80 are in abutment.

In a first alternative method, illustrated by FIG. 5, a selected amount of second cosmetic product 16 was added into the mixing space 84 before introducing the receptacle 36 into the base container 34, for example, by means of the tool 40.

In another alternative, the second cosmetic product 16 is added after transferring the cosmetic product 14 into the mixing space 84 through the passages 88.

Once the receptacle 36 is in its lower position, the user grasps the mixing tool 40 and homogenizes the mixture contained in the space 84 in order to form the cosmetic composition 12.

He/she then applies the cosmetic composition 12 on a body surface, for example on keratinous fibres or on the skin by distributing the composition through the aperture 112, without having to withdraw the base container 34 from the mixing receptacle 36.

Figure 10:
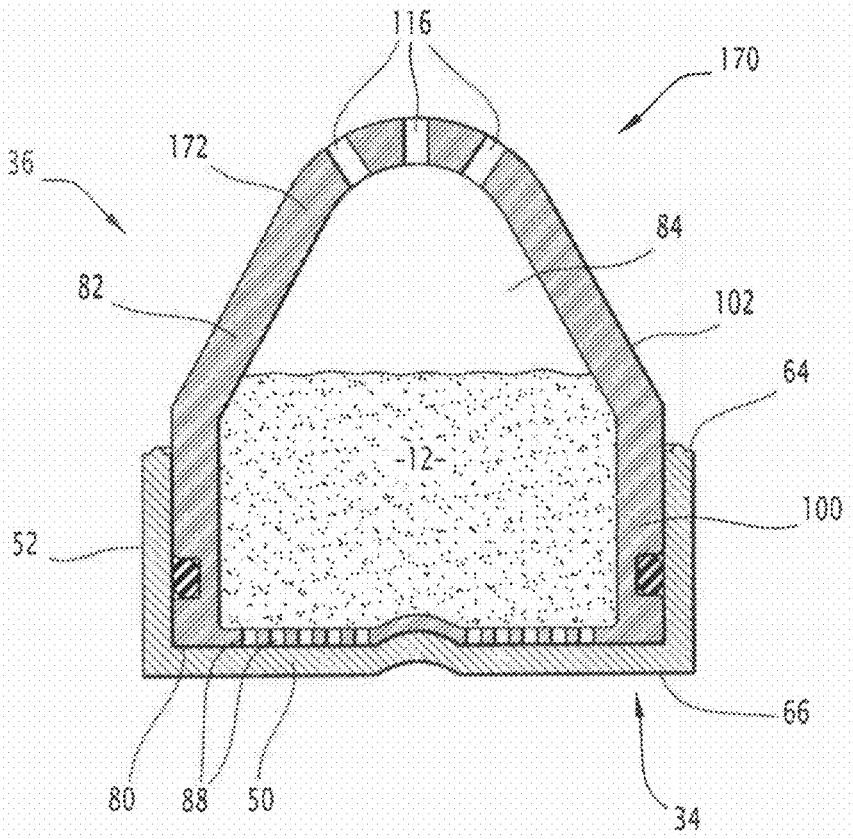
FIG. 10 is a view analogous to FIG. 7 of a second preparation device according to the invention.

A second kit 170 according to the invention is illustrated in FIG. 10.

Unlike the first kit 10, the mixing receptacle 36 comprises an upper wall 172 partly obturating the side wall 82 upwards.

Moreover, in this example, the side wall 82 is partly convergent towards the upper wall 172.

The upper wall 172 is pierced with a plurality of apertures 116 for accessing the product. The access apertures 116 for example have a size substantially equal to that of the passages 88 and allow distribution of the cosmetic composition 12 when the mixing receptacle 36 occupies its inner position in the base container 34.

In order to use the second kit 170, the user introduces the mixing receptacle 36 into the base container 34 as described earlier.

Next, he/she stirs the assembly formed by the base container 34 and the mixing receptacle 26 in order to homogenize the cosmetic composition 12 contained in the mixing space 84.

Next, he/she turns over the receptacle 36 in order to allow distribution of the cosmetic composition 12 outside the mixing space 84 through the apertures 116, for example by pressing the side wall 82, if the latter is deformable.

In one alternative (not shown), a dispenser plug or a capsule are added onto the wall 172 for selectively obturating the apertures 116 during the storage of the product.

Figure 11:
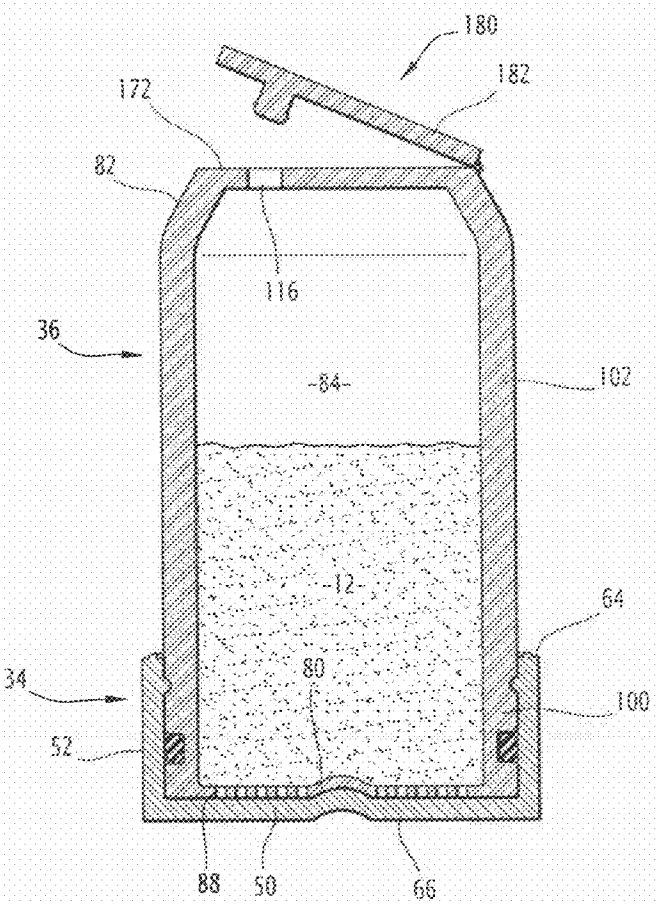
FIG. 11 is a view analogous to FIG. 7 of a third preparation device according to the invention.

FIG. 11 illustrates a third kit 180 according to the invention

As in the second kit 170, the mixing receptacle 36 includes an upper wall 172 obturating the side wall 82 upwards.

In this example, the upper wall 172 is made with the walls 80, 82 in the same material.

At least one access aperture 116 is defined in the upper wall 172. The aperture 116 may be selectively obturated with a removable plug fixedly mounted on the receptacle 36 either with a hinge, or by attachment of a capsule.

In the third kit 180, the second cosmetic product 16 is introduced into the mixing receptacle 36 during its manufacturing.

A temporary obturator (not shown) is then positioned under the pierced lower wall 80 in order to obdurate the circulation passages 88 downwards upon storing the mixing receptacle 36, before introducing it into the base container 34.

In order to use the third kit 180, the user first of all detaches the obturator present under the lower wall 80 in order to clear the circulation passages 88.

Next, he/she introduces the base container 34 into the mixing receptacle 36, as described earlier, in order to have the cosmetic product 14 pass into the mixing space 84 through the passages 88. He/she then stirs the assembly formed by the base container 34 and the mixing receptacle 36 for homogenizing the cosmetic composition 12 present in the mixing space 84. He/she then distributes the cosmetic composition 12 through the aperture 116.

In one alternative (not shown), the access aperture 116 is delimited by a neck protruding on the basis wall 172. A removable plug is mounted around the neck.

Figure 12:
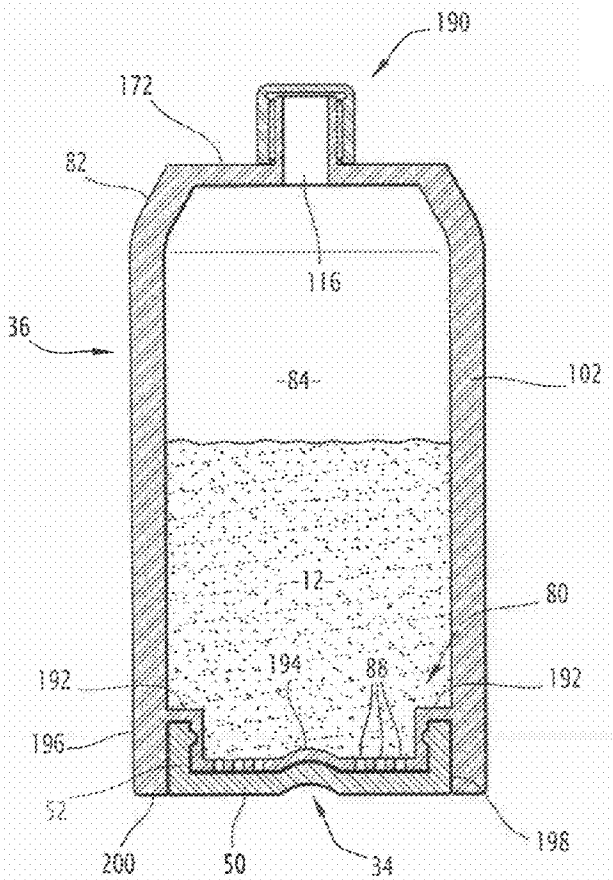
FIG. 12 is a view analogous to FIG. 7 of a fourth preparation device according to the invention.

A fourth kit 190 according to the invention is illustrated in FIG. 12.

Unlike the third kit 180, the bottom wall 80 includes a substantially planar peripheral region 192 and a central region 194 which protrudes downwards relatively to the peripheral region 192.

Circulation passages 88 are made in the central region 194.

The receptacle 36 further includes a lower peripheral skirt 196 extending the side wall 82 downwards beyond the peripheral region 192.

The skirt 196 and the regions 192, 194 of the bottom wall 80 delimit together a cavity 198 for receiving the base container 34 with a shape mating that of the base container 34. Thus, the central region 194 has a shape substantially conjugate with the shape of the inner space 54.

When the base container 34 occupies its inner position, the central region 194 is positioned in abutment, in contact with the bottom wall 50.

In this inner position, the peripheral wall 52 has been introduced into the annular space of conjugate shape delimited between the skirt 194 and the central region 196, below the peripheral region 192.

The bottom wall 50 is flush with the lower edge 200 of the skirt 196 or is located above this lower edge.

It is thus possible for the user to select the first cosmetic product 14 to be mixed with the second product 16 contained in the mixing space 84 in order to form a cosmetic composition 12 of the desired formula, by simply introducing the mixing receptacle 36 into the inner space 54 of the base container 34.

The kits 10, 170 180, 190 according to the invention as they have just been described, therefore allow transfer of a cosmetic product 14 which is difficult to homogenize into an easily accessible mixing space 84, while modifying the properties of this cosmetic product 14 in order to facilitate its mixing with a second cosmetic product 16.

The term of "one" is generally meant as "at least one" except if specified otherwise explicitly.

The invention claimed is:

1. A device for preparing a cosmetic composition, the device comprising:

a base container delimiting an inner space intended to receive a first cosmetic product, the inner space opening out through an insertion aperture;

a first cosmetic product received in the inner space;

a compression wall for compressing the first cosmetic product, configured to be mounted so as to be slideably mobile in the inner space through the insertion aperture between an outer position and an inner position for compressing the first cosmetic product, the compression wall delimiting at least one through-passage for circulating the first cosmetic product, the through-passage opening out into the inner space;

the device comprising a mixing receptacle of the cosmetic composition, the receptacle including:

the compression wall;

a side wall displaceable together with the compression wall, the side wall protruding from the compression wall and delimiting a mixing space into which the through-passage opens out, the receptacle having the general shape of a funnel opening upwards, delimiting at least one aperture for accessing the mixing space opening out towards the outside of the device when the compression wall occupies its inner position, the access aperture being distinct from the through-passage;

the side wall protruding out of the inner space of the container when the receptacle occupies its inner position, the access aperture remaining clear in the inner position; wherein the compression wall delimits a plurality of through-passages connecting the inner space to the mixing space, a cross-section of each through-passage being less than 10% of a total section of the compression wall; and the first cosmetic product comprises a plurality of deformable beads including a core and a frangible outer shell retaining the core.

2. The device according to claim 1, wherein the side wall of the receptacle has an outer contour of a shape complementary to the inner contour of the insertion aperture.

3. The device according to claim 2, further comprising a peripheral seal gasket interposed between the side wall and the container upon displacing the compression wall between the outer position and the inner position in order to force the first cosmetic product towards the mixing space through the through-passage.

4. The device according to claim 1, wherein the base container includes a bottom wall the compression wall abutting against the bottom wall in the inner position.

5. The device according to claim 1, wherein the base container comprises a supporting surface on a support, the insertion aperture opening out upwards when the supporting surface is laid on the support.

6. The device according to claim 1, wherein the side wall comprises a lower portion of dimensions substantially complementary to the inner space of the base container, and an upper portion with an increasing inner section upon moving away from the compression wall.

7. The device according to claim 1, wherein the base container includes a releasable assembly for closing the insertion aperture.

8. A kit for preparing a cosmetic composition, said kit comprising:

a device according to claim 1;

a package containing the device, wherein the base container, containing the first cosmetic product, is positioned in the package totally away from the mixing receptacle.

9. The kit according to claim 8, wherein the kit comprises a plurality of base containers, each the base container comprising a removable cap obturating the insertion aperture, thereby closing the inner space where the first cosmetic product is received.

10. The kit according to claim 8, further comprising a container including a second cosmetic product distinct from the first cosmetic product, the second cosmetic product being configured to be introduced into the mixing space and mixed with the first cosmetic product therein.

11. The device according to claim 1, wherein a maximum transverse extent of each through-passage of the compression wall is less than a maximum traverse extent of each bead of the first cosmetic product.

* * * * *